United States Patent [19]

Long

[11] 4,298,914

[45] Nov. 3, 1981

[54] ELECTRIC FIRING DEVICE

[76] Inventor: Alvin L. Long, Civilian Gen. Del., Beale Air Force Base, Calif. 95903

[21] Appl. No.: 91,553

[22] Filed: Nov. 5, 1979

Related U.S. Application Data

[63] Continuation-in-part of Ser. No. 906,092, Jun. 23, 1978, abandoned.

[51] Int. Cl.[3] ..... F41C 1/34

[52] U.S. Cl. ..... 362/112; 89/1 F; 89/1.814; 89/28 R; 362/114

[58] Field of Search ..... 42/1 A, 84; 89/1 F, 89/1 J, 1.8, 1.813, 1.814, 1.816, 28; 362/110, 111, 112, 113, 114

[56] References Cited

U.S. PATENT DOCUMENTS

| | | | |
|---|---|---|---|
| 785,644 | 3/1905 | Unge | 89/1 F |
| 1,471,063 | 10/1923 | Rognlie | 89/1 F |
| 2,597,565 | 5/1952 | Chandler et al. | 362/110 |
| 2,685,232 | 8/1954 | Brandt | 89/1.813 |
| 2,894,117 | 7/1959 | Koskey | 362/111 |
| 2,972,933 | 2/1961 | Guthrie et al. | 89/1.814 |
| 3,043,197 | 7/1962 | Piper et al. | 89/1.8 |
| 3,786,717 | 1/1974 | Vickers et al. | 89/1.814 |
| 3,915,091 | 10/1975 | Smith et al. | 89/1 F |
| 4,012,986 | 3/1977 | Germershausen et al. | 89/1 J |

*Primary Examiner*—Stephen C. Bentley

[57] ABSTRACT

An attachable, hand held pistol shaped electric firing device, containing a electric generator and a storage battery for firing weapons or explosive devices that can be activated by a electric pulse is disclosed.

A light projecting means for general use in the field is also contained. If a weapon to be fired has trailing wires, said wires are attached to electric terminals on the pistol shaped firing device, electricity from its battery is dispensed by depressing the trigger switch, direct current can also be dispensed by working the slide portion of the pistol shaped electric firing device, said slide portion activating the generator housed in the pistol grip.

If the pistol shaped electric firing device is to be applied to a weapon such as a high angle of fire mortar tube, a lug grove on top of the slide portion will allow it to be applied to a suitable lug on the mortar tube, with the breech cap removed from the mortar tube rockets can be fired horizontally.

1 Claim, 7 Drawing Figures

ELECTRIC FIRING DEVICE

This application is a continuation-in-part of application Ser. No. 906,092, filed June 23, 1978, now abandoned.

SUMMARY

The present invention relates to the many different kinds of hand held electric firing devices used by the military, such as a hand held generator used to detonate explosive devices, flash lights used for general use in the field, and many different types of electric firing devices used to fire rockets.

The present invention is a universal electric firing device shaped like a automatic pistol with a electric generator and a battery contained in its pistol grip.

A light projecting means is also contained in the forward part of the pistol shaped electric firing device. The pistol shape of the present electric firing device is similar to many grips on rocket launchers or for that matter grips on any hand held weapon.

It is believed that a standardization of all hand held electric firing devices would be a advantage to the military, and there is no reason why a universal electric firing device can not be successfully incorporated into the military weapons now existing.

A lug groove on the top of the present invention allows it to be applied to any weapon having a suitable lug to receive it, a second lug groove on the side of the present invention will allow a suitable sight to be applied, a suitable sight would depend on what the weapon was being used for.

Such weapons as disposable rocket launchers throw away their electric firing devices with the disposable rocket launch tube, this practice is considered wasteful for two reasons.

A. a disposable electric firing device is constructed as cheaply as possible and therefore over a long period of time subject to failure, B. the electric firing device for one weapon can not be used for anything else.

On the other hand a electric firing device that was well constructed could be used for many things such as, detonating explosive charges that have trailing wires, firing any type of rocket launching weapon, and a light projecting unit for general use in the field, also suitable for practice firing for pistol shooters. it is noted that this application appears to claim subject matter disclosed in applicants prior copending application Ser. No. 906,092, filed on 6-23-78, now abandoned.

DETAILED DESCRIPTION OF THE DRAWINGS

Figure 1:
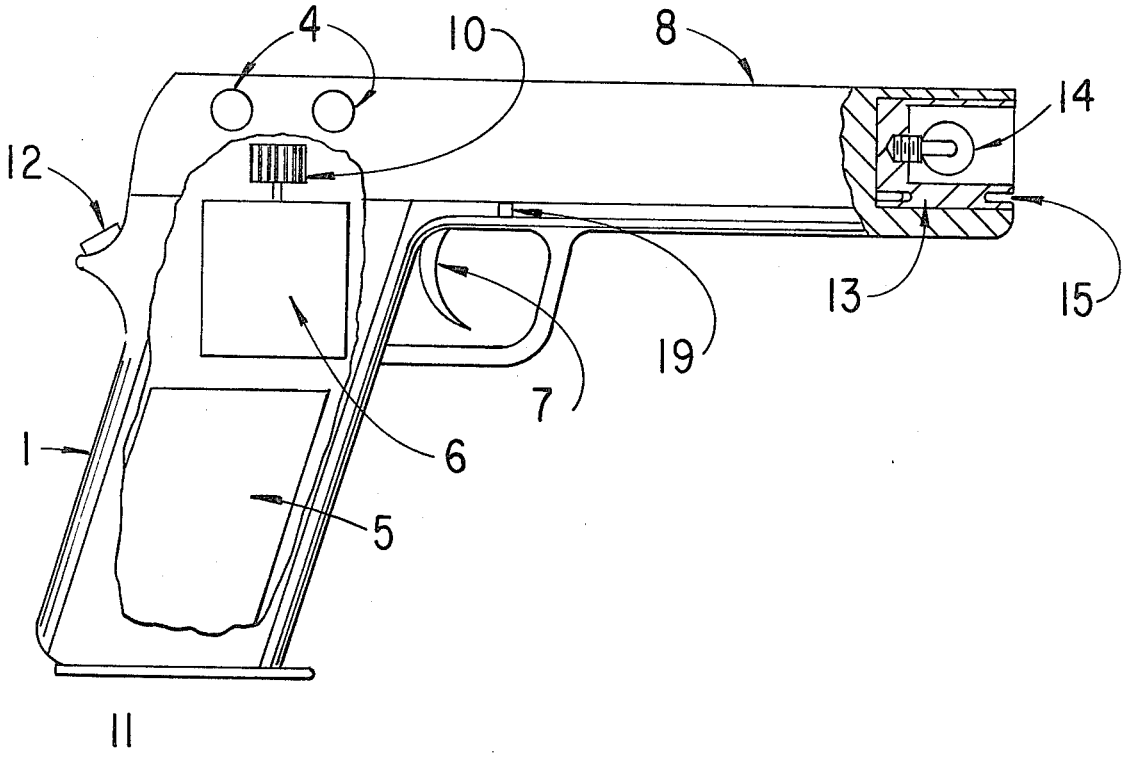
FIG. 1 is a cross section of the pistol shaped electric firing device showing the location of its battery, generator, gears for activating the generator, electric switches and plugs, and a light projecting means.
Figure 2:
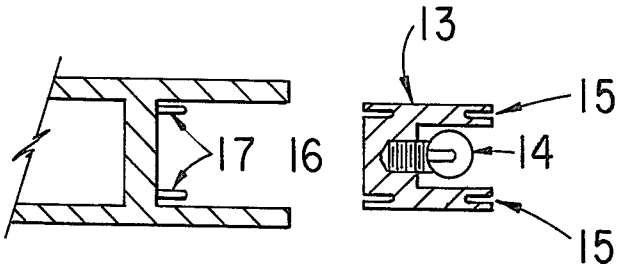
FIG. 2 is a cross section of the light projecting means and the muzzle of the electric firing device.
Figure 3:
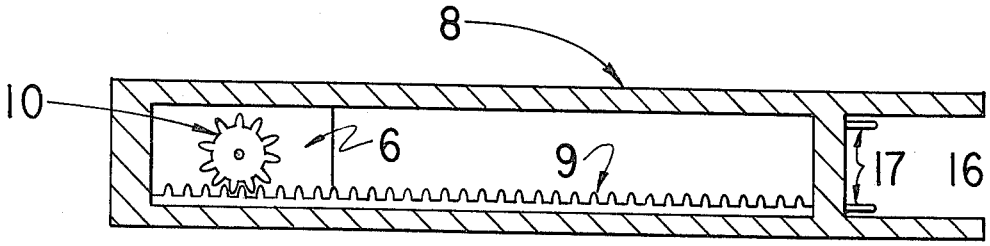
FIG. 3 is a cross section, top view of the electric firing device showing the gear teeth on the inside of the slide portion, a round gear is also shown on top of the electric generator housed in the pistol grip.
Figure 5:
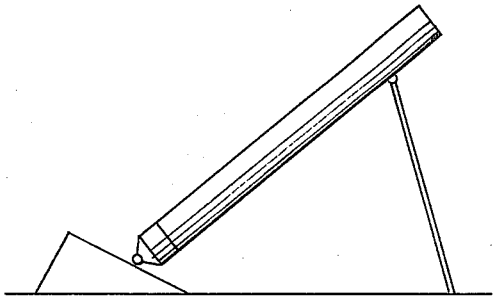
FIG. 5 is a side view of a high angle of fire mortar tube.
Figure 6:
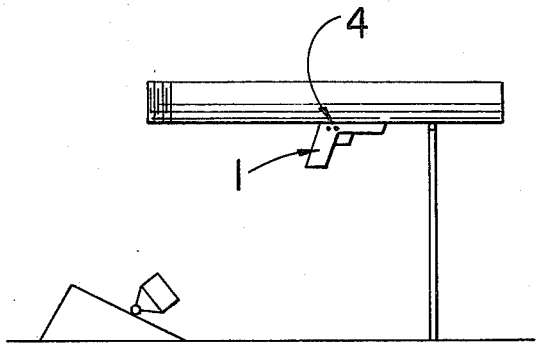
FIG. 6 is a side view of a high angle of fire mortar tube with its breach cap removed and a pistol shaped electric firing device in place on the mortar tube.

In the drawings FIG. 1 represents a pistol shaped electric generating and storage unit; said unit can be placed on a weapon such as a mortar tube FIG. 6, the pistol shaped unit 1 has a lug groove extending along the top of the slide portion 8, and any weapon that is to receive it must have a lug 3 applied to it.

Figure 4:
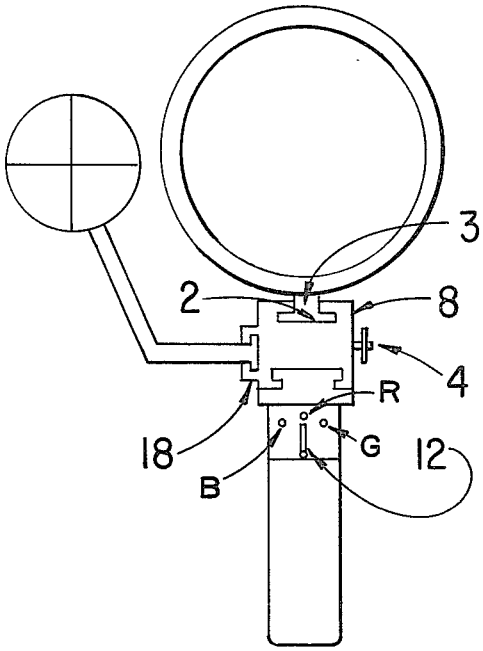
FIG. 4 is a back view of the electric firing device, attached to a rocket launching tube by use of a lug groove on the firing device and a lug on the rocket launch tube. A lug groove on the firing device side will accept a suitably prepared sight.
Figure 7:
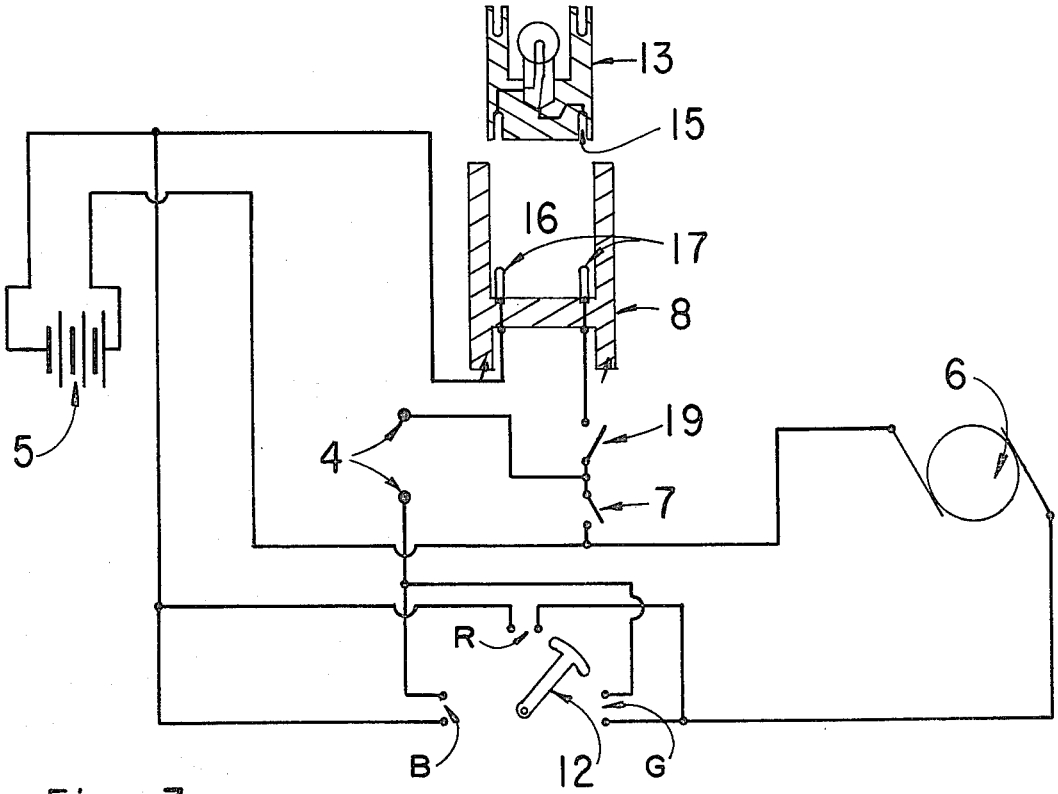
FIG. 7 is a diagram partly wiring and partly in block form illustrating the present pistol shaped electric firing device.

After the pistol shaped electric firing device 1 has been attached to a weapon as in FIG. 6, trailing wires from a rocket can be attached to the firing device 1 by winding them around the terminals 4, the terminals 4 will receive electrically from the battery 5 or generator 6 when the trigger 7 is pulled, the main electric switch 12 found on the upper part of the pistol grip see FIG. 4, and a detailed illustration in FIG. 7 regulates the flow of electric current from the battery and generator, for example if the battery 5 is to be used to release an electric pulse the main electric switch 12 is turned to B and the trigger switch 7 is depressed, this action completes an electric circuit through the terminals 4 when trailing wires are attached.

If the generator 6 is to be used to dispense a electric pulse to the terminals 4, the main electric switch 12 is turned to G for generator 6 and with the trigger switch 7 depressed and the slide portion 8 worked back and forth an electric pulse is generated and sent to the terminal 4. The battery 5 can be recharged by turning the main switch 12 to R for recharging, recharging is done by releasing the slide and working the slide portion 8 back and forth or if the electric firing device 1 is attached to a weapon the pistol grip and main body are worked back and forth. To use the light projecting unit 13 the main switch 12 is turned to R, the R setting will neutralize the terminals 4 and will allow the light projecting unit 13 to be used when its ON OFF switch 19 is turned to ON, the light projecting units 13 ON-OFF switch 19 can be found near the trigger switch 7.

The light projecting unit 13 is reverseable so that the light will be protected when not in use, the recess 16 that the light projecting unit 13 fits into can be used as a plugin means for a weapon that the firing device 1 is attached to, the recess 16 has male plugs 17 that fit into female plugs 15 on both ends of the light projecting unit 13.

A universal lug groove for a suitable sight 18 extends along the left side of the slide portion 8 of the electric firing device.

A suitable sight will depend on what type of weapon the electric firing device 1 is placed on, all weapons do not use the same type of sight. The piston shaped electric firing device 1 is of a similar construction and size of a military 45 caliber automatic pistol, having a slide portion 8 that can be worked back and forth, a slide release lever to secure the slide when not in use, a removable magazine housed in the pistol grip with a magazine release button, and a trigger for firing, said trigger having a safety.

What is claimed is:

1. In a electric firing device for firing rockets, said firing device being inherently capable of being used for firing rockets from a mortar tube, and having batteries and triggering device, said firing device having a sighting device attached, in combination with a hand held electric generator, and a light projecting unit for automatic pistols, what is new comprizing:

A. an attachable electric firing device with a simila size and construction of a military 45 caliber automatic pistol, containing a battery and generator, B. said battery and generator being contained in a removable magazine like container, C. a slide portion on top of the pistol shaped electric firing device that will activate the electric generator when worked back and forth, D. a trigger switch on said firing device for supplying a electric pulse from the battery or generator, E. a removable light projecting unit contained in a muzzle cavity of the electric firing device, said unit having external and internal female electric plugins, F. a lug groove extending along the full length of the top portion of the slide for attaching to a weapon, G. a lug groove extending along the full length of the side portion of the slide for attaching a suitable sight, H. a pistol shaped electric firing device applied to a high angle of fire mortar tube, said mortar tube having its breech cap removed to fire rockets horizontally, I. electric terminals on the side of the piston shaped electric firing device for attaching trailing wires from any explosive device or weapon that can be fired by a electric pulse.

* * * * *